US006734770B2

(12) United States Patent
Aigner et al.

(10) Patent No.: US 6,734,770 B2
(45) Date of Patent: May 11, 2004

(54) MICRORELAY

(75) Inventors: Robert Aigner, München (DE); Sven Michaelis, Hamburg (DE); Florian Plötz, Regensburg (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/211,058

(22) Filed: Aug. 2, 2002

(65) Prior Publication Data

US 2003/0006868 A1 Jan. 9, 2003

Related U.S. Application Data

(63) Continuation of application No. PCT/DE01/00389, filed on Feb. 1, 2001.

(30) Foreign Application Priority Data

Feb. 2, 2000 (DE) ..... 100 04 393

(51) Int. Cl.[7] ..... H01H 51/22
(52) U.S. Cl. ..... 335/78; 335/83; 200/181
(58) Field of Search ..... 335/78, 79–86

(56) References Cited

U.S. PATENT DOCUMENTS

| | | | | | |
|---|---|---|---|---|---|
| 5,872,496 | A | * | 2/1999 | Asada et al. | 335/78 |
| 6,040,748 | A | * | 3/2000 | Gueissaz | 335/78 |
| 6,046,659 | A | * | 4/2000 | Loo et al. | 333/262 |
| 6,160,230 | A | * | 12/2000 | McMillan et al. | 200/181 |
| 6,384,353 | B1 | * | 5/2002 | Huang et al. | 200/181 |
| 6,433,657 | B1 | * | 8/2002 | Chen | 333/262 |
| 6,473,361 | B1 | * | 10/2002 | Chen et al. | 365/244 |
| 2002/0050882 | A1 | * | 5/2002 | Hyman et al. | 335/78 |
| 2002/0140533 | A1 | * | 10/2002 | Miyazaki et al. | 335/78 |

* cited by examiner

*Primary Examiner*—Anh Mai
*Assistant Examiner*—Bernard Rojas
(74) *Attorney, Agent, or Firm*—Laurence A. Greenberg; Werner H. Stemer; Ralph E. Locher

(57) ABSTRACT

A microrelay has a switching part which is pivotably suspended on a substrate and can be moved into two alternative switching states like a rocker, by electrostatic attraction through the use of suitably attached electrodes. The switching function is brought about by electrodes which are fastened to the substrate above the rocker being shorted by metallizations or contact electrodes on an upper side of the switching part.

11 Claims, 2 Drawing Sheets

MICRORELAY

CROSS-REFERENCE TO RELATED APPLICATION

This application is a continuation of copending International Application No. PCT/DE01/00389, filed Feb. 1, 2001, which designated the United States and was not published in English.

BACKGROUND OF THE INVENTION

Field of the Invention

The present invention relates to an electrostatically operating microrelay, which can be used as a switch and which can be produced by the methods of micromechanics.

Electrostatic microswitches are ideally suited and distinctly superior to other semiconductor switches as far as attenuation and noise characteristics are concerned, in particular for applications in the radio-frequency range. A major advantage of switches of that type is that, apart from capacitive charging currents, powerless control of the switching contacts is possible. Electrostatic switches with a small switching time in a range below 100 $\mu$s can only be realized by conventional methods if very great switching voltages can be accepted. It is generally the case with known ways of accomplishing the same that a compromise has to be made between the switching speed and the required switching voltage, since the rigidity of the resilient suspension of the switching element has the effect of requiring high switching voltages for high switching speeds. Battery voltages of at most 3 V are typically available, especially for use in cell phones. Switching voltages of at most 12 V are achievable by using voltage multipliers. Micromechanical switches are usually formed by micromechanically producible bars, at the end of which the switching contacts are disposed and which can be bent by electrostatic attraction through the use of electric potentials on suitably attached electrodes, in order to close the contacts. Electric voltages of typically 30 V and more are required in the case of switching times of 20 $\mu$s. Therefore, those components are unsuitable for use in cell phones or other low-power applications.

In German Patent DE 41 13 190 C1 there is a description of an electrostatically actuated microswitch, in which an armature part constructed as a rocker has an armature spaced apart from a force electrode that is disposed on a base and is provided with two switching contacts on mutually opposite sides. When the device is actuated, those switching contacts alternately short two pairs of counterelectrodes provided as switches, which are disposed on the base.

In German Patent DE 198 23 690 C1 there is a description of a micromechanical electrostatic relay, in which a rib-shaped armature pivotably suspended in the region of a central pivot axis through the use of flexible bands is formed in an armature substrate. The armature forms an armature wing on each side of the pivot axis. The armature wing is in itself flexible and, in its inoperative state, is bent away from the base substrate, rolls on a base electrode and closes an associated contact when the device is actuated.

In German Patent DE 198 20 821 C1 there is a description of an electromagnetic relay which has a rocking armature with an armature plate, that is suspended in such a way that it can pivot transversely to the longitudinal direction of the armature plate through the use of two torsion springs, which are connected by a holding plate. The torsion springs and the holding plate provided for fastening the rocking armature are disposed in an inner recess of the armature plate.

In German Patent DE 42 05 340 C1 there is a description of a micromechanical, electrostatic relay in which an armature substrate within a frame carries a plate-shaped armature through the use of flexible supporting strips. In that way, an armature electrode provided on the armature is face-to-face with a base electrode and the armature is kept parallel to the base electrode through the use of the supporting strips and, when a voltage is applied between the armature electrode and the base electrode, comes to bear against the base electrode over its full surface area perpendicularly to the plane of the electrodes.

In a publication entitled "Micromechanical Switches Fabricated Using Nickel Surface Micromachining" by P. M. Zavracky et al. in the Journal of Microelectromechanical Systems 6, 3–9 (1997), a description is given of micromechanical switches in which terminal contacts to be connected to one another in an electrically conducting manner are shorted through the use of a switching contact attached to a bar when the bar is bent toward the substrate by electrostatic force. That is accomplished by applying a voltage between the electrically conducting bar and a counterelectrode on the substrate.

In a publication entitled "Micromechanical Relay with Electrostatic Actuation" by I. Schiele et al. in Transducers '97, 1997 International Conference on Solid-State Sensors and Actuators, Chicago, pages 1165–1168, a description is given of a microrelay in which, for closing the switch, a bar capable of bending is likewise electrostatically drawn toward the substrate and in which there is a T-shaped metallic lug on the bar for shorting the terminal contacts to be connected to one another in an electrically conducting manner. The lug is electrically insulated from the rest of the bar.

In a publication entitled "Design and Fabrication of Micro Mirror Supported by Electroplated Nickel Posts" by Seok-Whan Chung et al. in Transducers '95 Eurosensors IX, Proceedings of the 8th International Conference on Solid-State Sensors and Actuators, and Eurosensors IX, Stockholm, pages 312–315, a description is given of a micromirror. The micromirror is suspended from torsion springs and can be electrostatically tilted.

SUMMARY OF THE INVENTION

It is accordingly an object of the invention to provide a microrelay, which overcomes the hereinafore-mentioned disadvantages of the heretofore-known devices of this general type and which is a component that can be used as a switch and achieves high switching speeds at a small switching voltage.

With the foregoing and other objects in view there is provided, in accordance with the invention, an electrostatically operating microrelay, comprising a substrate, a switching part movably attached on the substrate and having a side facing away from the substrate, the switching part acting as a rocker moving between two alternative switching positions, a contact electrode attached on the substrate and having two parts provided with separate electrical terminals, a contact electrode attached to the switching part, an actuator electrode disposed at the switching part and two actuator electrodes attached on the substrate. The actuator electrodes attached on the substrate are disposed relative to the actuator electrode attached to the switching part to bring about a rocking movement of the switching part into another of the two alternative switching positions by alternately applying an electric potential to the actuator electrodes attached on the substrate. The contact electrode attached on the substrate is disposed at the side of the switching part facing away from the substrate, permitting the contact electrode attached to the switching part to short the two parts of the contact electrode attached on the substrate in one of the switching positions.

Thus, the microrelay according to the invention has a switching part which is pivotably suspended on a substrate and can be moved into two alternative switching states in the manner of a rocker by electrostatic attraction through the use of suitably attached electrodes. The switching function is brought about by electrodes which are fastened to the substrate above the rocker being shorted by metallizations on the upper side of the switching part.

Other features which are considered as characteristic for the invention are set forth in the appended claims.

Although the invention is illustrated and described herein as embodied in a microrelay, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
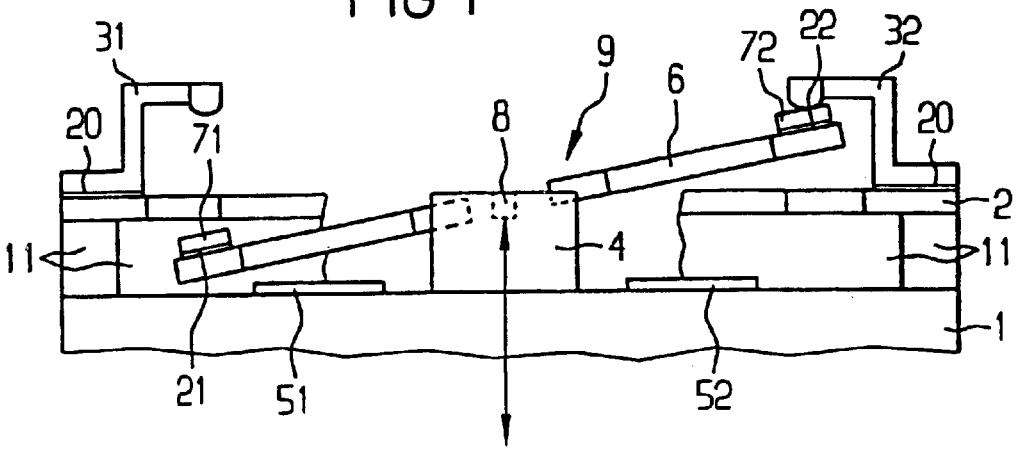
FIG. 1 is a fragmentary, diagrammatic, cross-sectional view of an example of a microrelay.

Referring now to the figures of the drawings in detail and first, particularly, to FIG. 1 thereof, there is seen a substrate 1. Remaining parts of an auxiliary layer or sacrificial layer 11, of a patterned layer 2 and of an electrically insulating layer 20 as well as contact electrodes 31, 32, which are firmly attached with respect to the substrate, are illustrated in cross section on the substrate 1 or a layer or layered structure present on the substrate. An actual switching part 9 is suspended on a structured part which is provided as an anchorage 4 and is located on the substrate 1 or a layer present thereon. The anchorage 4 is disposed in a clearance in the layers 11, 2, the central part of which has been omitted in the figure for the sake of overall clarity and is only indicated by rupture lines. In order to make this possible, in this exemplary embodiment, the switching part 9 has a clearance in the center in which the anchorage 4 is disposed. Struts 8, aligned along an intended pivot axis and acting as torsion springs, are located between the switching part 9 and the anchorage 4. These pivotable struts 8 make it possible for the switching part 9 suspended on them to move about a pivot axis formed by the struts 8, so that the switching part 9 performs a rocking movement.

The switching part 9 is preferably produced together with the struts 8 and the anchorage 4 or at least an upper part of the anchorage 4, from the patterned layer 2. The patterned layer in this case is formed of a material which has suitable mechanical properties, in particular in order to ensure adequate stability of the switching part 9 and at the same time adequate elasticity of the struts 8 for a restoring spring force. Silicon-containing material is preferably considered for this purpose, in particular polysilicon, monosilicon (for example a body silicon layer of an SOI substrate, including a lower bulk silicon layer, thin insulating layer and thin upper body silicon layer, noting that the insulating layer may be used as a sacrificial layer) or the compound semiconductor SiGe.

Contact electrodes 71, 72 are attached to the switching part 9. The switching part also has at least one actuator electrode 6 attached thereto which, when polysilicon is used for the switching part, can be produced by implantation of dopant in the polysilicon. Actuator electrodes 51, 52 are attached on the substrate 1 (or a layer or layered structure present thereon) as counterelectrodes for this purpose. The attachment is provided in such a way that, by alternately applying electric potentials to one of these actuator electrodes 51, 52, a rocking movement of the switching part can be induced due to electrostatic attraction brought about as a result. Therefore, a switchover from one switching position into another is effected. If the switching part 9 is formed of semiconductor material in which the actuator electrode 6 is formed by introducing dopant, the semiconductor material of the struts 8 and of the anchorage 4 may likewise be doped in an electrically conducting manner. In that way, an electrical connection to the actuator electrode 6 of the switching part 9 is made possible through the anchorage to the substrate. Instead of this, however, there may also be an electrically insulated actuator electrode of the switching part which is at free electric potential (floating). An electrical attraction to the actuator electrodes 51, 52 fastened to the substrate is then induced by the influence of an electric charge.

The contact electrodes 71, 72 which are located on the switching part 9 and provided for the actual switching function, are preferably electrically insulated from the actuator electrode 6 present on the switching part. For this purpose there may be electrically insulating layers 21, 22, for example parts of the electrically insulating layer 20, between the contact electrodes 71, 72 and the switching part 9. In the case of the microrelay according to the invention, the contact electrodes 71, 72 are located on the upper side of the switching part forming the rocker. In the switching position represented in FIG. 1, in which the left part of the switching part 9 is attracted by the actuator electrode 51 present on the substrate, the contact electrode 71 therefore shorts the switch formed by the contact electrode 32 fastened to the substrate. This is clear from the plan view represented in FIG. 2.

Figure 2:
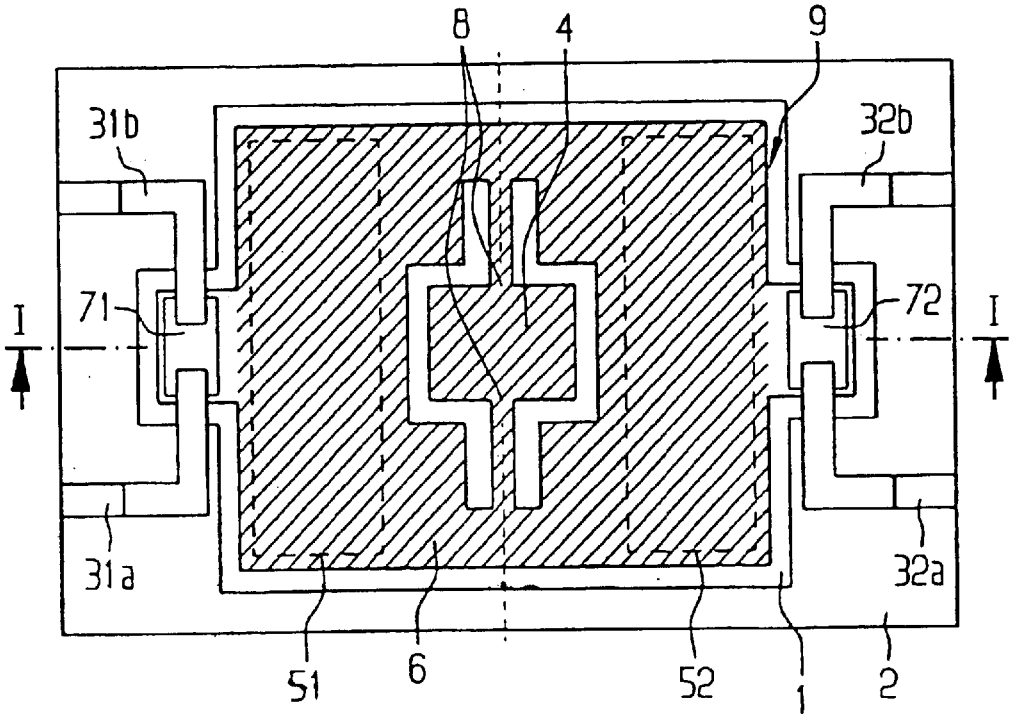
FIG. 2 is a plan view which illustrates the embodiment according to FIG. 1.

In FIG. 2, the substrate can be seen between the patterned layer 2 and the switching part 9. In this exemplary embodiment, the anchorage 4 is located in a central clearance of the switching part, which is connected to the anchorage 4 through the struts 8 acting as torsion springs. Instead of this, it is possible to construct the switching part, for example, as an integral plate, on which the struts provided as suspensions are attached laterally toward the outside. The contact electrodes 71, 72 that are attached on the switching part 9 are located on an upper side of the switching part 9, in this case on laterally structured lugs. In this example, the actuator electrode 6 of the switching part 9 is formed as an implantation of dopant in polysilicon. This implantation includes the region shown hatched in FIG. 2, including the struts 8 and the anchorage 4. In the lateral lugs, which carry the contact electrodes 71, 72, the doping has been omitted, so that the polysilicon is electrically insulated in this case, or at least has only a low electrical conductivity. The doping may, however, also be present in the entire switching part 9. An adequate electrical insulation of the contact electrodes 71, 72 can be brought about, if required, by the electrically insulating layers 21, 22 (for example a nitride such as $Si_3N_4$) between the contact electrodes 71, 72 and the switching part 9. The profile of the cross section represented in FIG. 1 and the concealed contours of the actuator electrodes 51, 52 fastened to the substrate are shown by dashed lines in FIG. 2.

The structuring of the contact electrodes 31, 32 attached to the substrate, which in each case have two parts 31*a*, 31*b* and 32*a*, 32*b* disposed at a small distance from one another, can be clearly seen in FIG. 2. These parts are respectively disposed and aligned in such a way that, with the rocking switching part in a suitable position, they are shorted by a respective contact electrode 71, 72 on its upper side. Consequently, in this exemplary embodiment, the switching over of the microrelay can be used to perform two switching functions simultaneously, with which one switch is closed and another switch is opened at the same time. Alternatively, it is possible to restrict the microrelay to one switching function, in that for example the second contact electrodes 32, 72 on the right side are omitted or not connected. A double-headed arrow depicted in FIG. 1 indicates a correspondence between the pivot axes provided by the respectively depicted struts 8 in FIG. 1 or (shown by dots) in FIG. 2. The contact electrodes 31, 32 may be attached on an electrically insulating layer 20 and connected through the use of interconnects or be provided with electrical terminals through conductors in the patterned layer 2.

Figure 3:
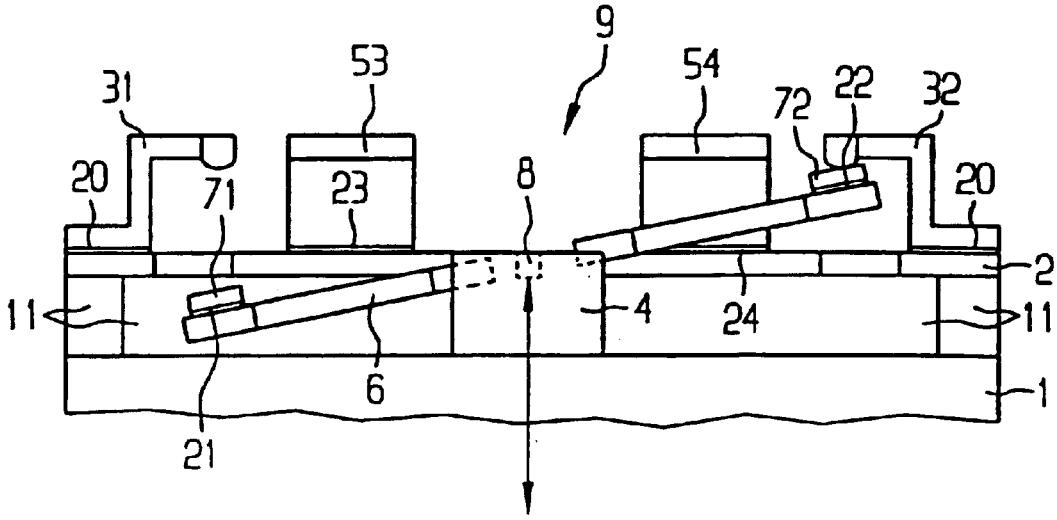
FIG. 3 is a view similar to FIG. 1 of a further example of a microrelay.

An alternative exemplary embodiment is shown in cross section in FIG. 3. In this embodiment, actuator electrodes 53, 54 of the substrate are attached on the patterned layer 2, which is shown as being continuous in this case, as well as on electrically insulating layers 23, 24 that are present thereon in this example. The actuator electrodes 53, 54 are disposed on the side of the switching part 9 facing away from the substrate 1, thereby preferably spanning the switching part 9 in a bridge-like manner.

Figure 4:
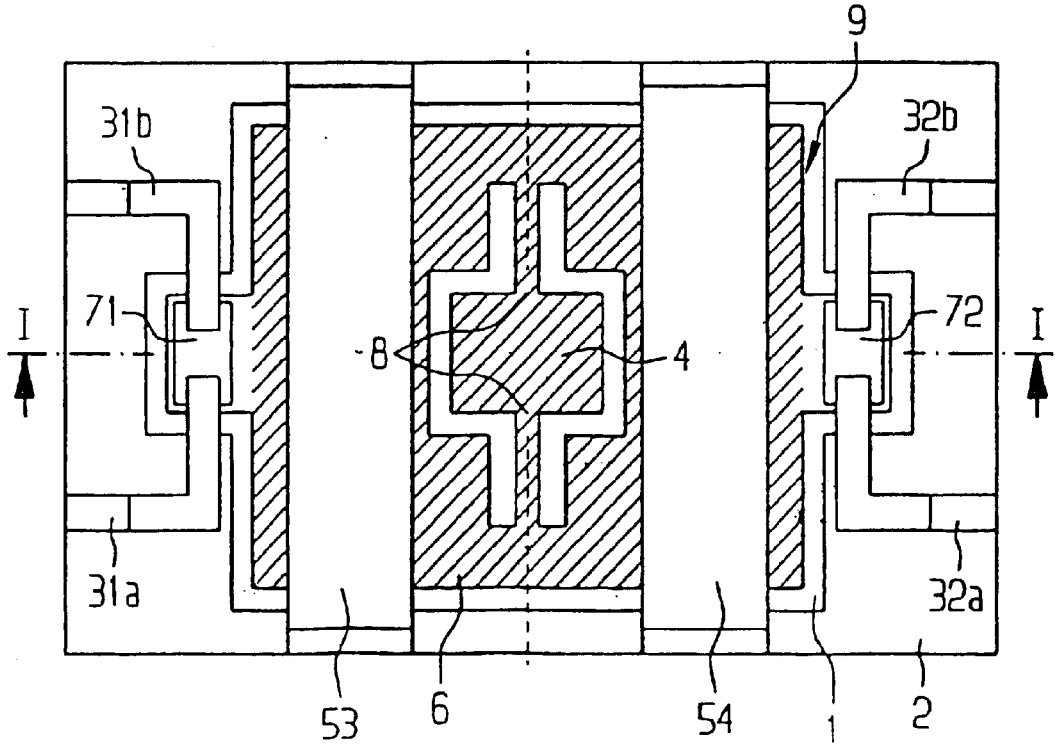
FIG. 4 is a view similar to FIG. 2 of the embodiment according to FIG. 3.

The plan view which is shown in FIG. 4 illustrates two sheet-like parts of the actuator electrodes 53, 54 over the switching part 9. These actuator electrodes may in principle take any form desired. The preferred configuration represented has good mechanical stability. It simplifies production if all of the electrodes attached to the substrate, the actuator electrodes 53, 54 and the contact electrodes 31, 32, are structured together. The upper parts of all of the electrodes are then located at the same height above the substrate.

As a further embodiment, actuator electrodes attached to the substrate may be disposed both under the switching part and above the switching part. This improves the switching force due to a greater achievable torque.

It is important for the microrelay according to the invention that a rocker-like switching part is provided as an actuator, on the upper side of which contact electrodes with which switches are closed are attached. The fact that there is a separate actuator electrode 51, 52 for both switching directions makes it possible to set the speed of the switching-over operation independently of the restoring force of the torsion spring formed by the struts 8. The switch formed by this microrelay is therefore not in a force-free or uncontrolled state during switching on or switching off and can therefore be forced very much more quickly into the stationary end state (end stop of one switching position). The only restriction on the switching speed is the inertia caused by the moment of inertia of the rocker and the available actuator force, which is substantially limited by the applied electric voltage. The restoring force brought about by the spring is of less significance in comparison. The actuator force which is electrostatically applied by the actuator electrodes depends by a power of two on the applied electric voltage and is otherwise determined exclusively by the geometry of the configuration. Apart from the geometry, the moment of inertia also crucially depends on the specific density of the material of which the switching part 9 is formed. Therefore, the movable part is preferably produced from a material of low density, preferably from polysilicon. Metallic coatings (for example electrodeposited metals or sputtered metallizations) may be applied merely for the electrodes. The microrelay according to the invention with contacts closing upward (that is to say away from the substrate) makes a significant reduction in the moved mass (moment of inertia) possible, and consequently an increase in the switching speed with an unchanged low switching voltage, since the heavier part of the contact electrodes forming the switch remains stationary with respect to the substrate. The properties of the switch and the exertion of the switching force are decisively improved in the case of the configuration according to the invention in comparison with conventional switches.

We claim:

1. An electrostatically operating microrelay, comprising:

a substrate, said substrate having a contact electrode and two actuator electrodes attached to said substrate, said contact electrode having two parts provided with separate electrical terminals;

a switching part movably attached to said substrate, said switching part having a side facing away from said substrate, a contact electrode attached on said side and an actuator electrode attached to said switching part, said switching part acting as a rocker moving between two alternative switching positions;

said two actuator electrodes attached to said substrate being disposed relative to said actuator electrode attached to said switching part to bring about a rocking movement of said switching part from one of said two alternative switching positions into another of said two alternative switching positions by alternately applying an electric potential to said two actuator electrodes attached to said substrate; and said contact electrode attached to said substrate being disposed at said side of said switching part facing away from said substrate, permitting said contact electrode attached to said switching part to short said two parts of said contact electrode attached to said substrate in one of said switching positions.

2. The microrelay according to claim 1, which further comprises:

another contact electrode attached to said switching part; and another contact electrode attached to said substrate, having two parts provided with separate electrical terminals and disposed on said side of said switching part facing away from said substrate;

said contact electrodes attached to said switching part each shorting said two parts of a respective one of said contact electrodes attached to said substrate, in each of said switching positions of said switching part.

3. The microrelay according to claim 1, wherein said switching part is formed of a material selected from the group consisting of polysilicon, monosilicon and SiGe, and said contact electrode attached to said switching part is formed of metal applied to said switching part.

4. The microrelay according to claim 3, wherein said actuator electrode disposed at said switching part is formed of an implanted dopant.

5. The microrelay according to claim 1, which further comprises an electrically insulating layer between said switching part and said contact electrode attached to said switching part.

6. The microrelay according to claim 1, which further comprises an anchorage fastened on said substrate, and struts aligned along a pivot axis, forming torsion springs and suspending said switching part on said anchorage.

7. The microrelay according to claim 1, wherein said actuator electrodes attached to said substrate are disposed between said substrate and said switching part.

8. The microrelay according to claim 1, wherein said actuator electrodes attached to said substrate are disposed on said side of said switching part facing away from said substrate.

9. The microrelay according to claim 1, wherein at least one of said actuator electrodes attached to said substrate is disposed between said substrate and said switching part and at least one of said actuator electrodes attached to said substrate is disposed on said side of said switching part facing away from said substrate.

10. An electrostatically operating microrelay, comprising:

a substrate, said substrate having a contact electrode and two actuator electrodes attached to said substrate, said contact electrode having two parts provided with separate electrical terminals;

a switching part movably attached to said substrate, said switching part having a side facing away from said substrate, a contact electrode attached on said side and an actuator electrode attached to said switching part, said switching part acting as a rocker moving between two alternative switching positions;

said actuator electrodes attached to said substrate being disposed on said side of said switching part facing away from said substrate, said two actuator electrodes attached to said substrate being disposed relative to said actuator electrode attached to said switching part to bring about a rocking movement of said switching part from one of said two alternative switching positions into another of said two alternative switching positions by alternately applying an electric potential to said two actuator electrodes attached to said substrate;

said contact electrode attached to said substrate being disposed at said side of said switching part facing away from said substrate, permitting said contact electrode attached to said switching part to short said two parts of said contact electrode attached to said substrate in one of said switching positions; and at least one of said actuator electrodes disposed on said side of said switching part facing away from said substrate being bridge-shaped and spanning said switching part.

11. An electrostatically operating microrelay, comprising:

a substrate, said substrate having a contact electrode and two actuator electrodes attached to said substrate, said contact electrode having two parts provided with separate electrical terminals;

a switching part movably attached to said substrate, said switching part having a side facing away from said substrate, a contact electrode attached on said side and an actuator electrode attached to said switching part, said switching part acting as a rocker moving between two alternative switching positions;

at least one of said actuator electrodes attached to said substrate being disposed between said substrate and said switching part and at least one of said actuator electrodes attached to said substrate being disposed on said side of said switching part facing away from said substrate, said two actuator electrodes attached to said substrate being disposed relative to said actuator electrode attached to said switching part to bring about a rocking movement of said switching part from one of said two alternative switching positions into another of said two alternative switching positions by alternately applying an electric potential to said two actuator electrodes attached to said substrate;

said contact electrode attached to said substrate being disposed at said side of said switching part facing away from said substrate, permitting said contact electrode attached to said switching part to short said two parts of said contact electrode attached to said substrate in one of said switching positions; and at least one of said actuator electrodes disposed on said side of said switching part facing away from said substrate being bridge-shaped and spanning said switching part.

* * * * *